US006590485B2

(12) United States Patent
Fujiwara et al.

(10) Patent No.: US 6,590,485 B2
(45) Date of Patent: Jul. 8, 2003

(54) MAGNETIC CORE HAVING MAGNETICALLY BIASING BOND MAGNET AND INDUCTANCE PART USING THE SAME

(75) Inventors: Teruhiko Fujiwara, Sendai (JP); Masayoshi Ishii, Sendai (JP); Haruki Hoshi, Sendai (JP); Keita Isogai, Sendai (JP); Toru Ito, Miyagi (JP); Tamiko Ambo, Tokyo (JP)

(73) Assignee: NEC Tokin Corporation, Sendai (JP)

( * ) Notice: Subject to any disclaimer, the term of this patent is extended or adjusted under 35 U.S.C. 154(b) by 27 days.

(21) Appl. No.: 09/996,048

(22) Filed: Nov. 28, 2001

(65) Prior Publication Data

US 2002/0093409 A1 Jul. 18, 2002

(30) Foreign Application Priority Data

Nov. 29, 2000 (JP) ..... 2000-363569
Nov. 29, 2000 (JP) ..... 2000-363613
Apr. 17, 2001 (JP) ..... 2001-117665

(51) Int. Cl.[7] ..... H01F 1/18

(52) U.S. Cl. ..... 336/83; 336/110; 148/300; 148/301

(58) Field of Search ..... 336/83, 178, 110; 335/234, 229; 428/328, 323; 148/300, 301

(56) References Cited

U.S. PATENT DOCUMENTS 5,128,645 A 7/1992 Suda
6,432,158 B1 * 8/2002 Harada et al. ..... 75/245

FOREIGN PATENT DOCUMENTS

| | | | |
|---|---|---|---|
| DE | 32 02 600 A | | 9/1982 |
| JP | 50-133453 | | 10/1975 |
| JP | 4102425 | * | 9/1998 |
| JP | 2002-164223 | * | 7/2002 |

OTHER PUBLICATIONS

Patent Abstracts of Japan, vol. 009, No. 123 (E–317). May 28, 1985, and JP 60–010605 A (Hitachi Kinzoku KK), Jan. 19, 1985—Abstract only.

* cited by examiner

*Primary Examiner*—Anh Mai
(74) *Attorney, Agent, or Firm*—Frishauf, Holtz, Goodman & Chick, P.C.

(57) ABSTRACT

A magnetic core having excellent DC superposition characteristics and core-loss characteristics is provided. The magnetic core comprises a magnetically biasing magnet disposed in a magnetic gap thereof to provide a magnetic bias from opposite ends of the magnetic gap to the core. The said magnetically biasing magnet comprises a bond magnet which comprises rare-earth magnetic powder and a binder resin. The rare-earth magnetic powder has an intrinsic coercive force of 5 kOe or more, a Curie temperature Tc of 300° C. or more, specific resistance of 0.1 Ω·cm or more, residual magnetization Br of 1000 to 4000 G and coercive force bHc of a B-H curve of 0.9 kOe or more.

4 Claims, 6 Drawing Sheets

MAGNETIC CORE HAVING MAGNETICALLY BIASING BOND MAGNET AND INDUCTANCE PART USING THE SAME

BACKGROUND OF THE INVENTION

This invention relates to a magnetic core of an inductance device such as a choke coil, transformer or the like, particularly, relates to a magnetic core (which will hereinunder be often referred to as "core" simply) which has a permanent magnet as a magnetically biasing magnet.

To a choke coil and a transformer used in, for example, a switching power supply or the like, an AC current is usually applied thereto together with a DC current superposed thereto. Therefore, a core used in those choke coil and transformer is required to have a magnetic characteristic of a good magnetic permeability so that the core is not magnetically saturated by the superposition of the DC current (the characteristic will be referred to as "DC superposition characteristic" or simply as "superposition characteristic").

As magnetic cores in application fields within high frequency bands, there have been used a ferrite core and a dust core which have individual features due to physical properties of their materials, the ferrite core has a high intrinsic magnetic permeability and a low saturated magnetic flux density while the dust core has a low intrinsic magnetic permeability and a high saturated magnetic flux density. Accordingly, the dust core is often used as one having a toroidal shape. On the other hand, the ferrite magnetic core has an E-shape core part having a central leg formed with a magnetic gap so as to prevent magnetic saturation from being caused by the superposition of DC current.

Recently, since electronic parts are required to be small-sized as electronic devices are more compact-sized, the magnetic core with the magnetic gap is small-sized too. So, there is a strong demand for magnetic cores having an increased magnetic permeability against superposition of DC current.

Generally, it is necessary for the demand to select a magnetic core having a high saturation magnetization, that is, to select a magnetic core that is not magnetically saturated by a high magnetic field applied. The saturation magnetization is inevitably determined by materials and cannot be made as high as desired.

As a solution, it has been conventionally proposed to dispose a permanent magnet in a magnetic gap formed in a magnetic path of a magnetic core, that is, to magnetically bias the magnetic core, to thereby cancel a DC magnetic flux caused by the superposition of DC current.

The magnetic bias by use of the permanent magnet is a good solution to improve the DC superposition characteristic, but it have hardly been brought into a practical use because use of a sintered metallic magnet resulted in considerable increase of a core loss of the magnetic core, while use of a ferrite magnet led in unstable superposition characteristic.

In order to resolve the problems, for example, JP-A 50-133453 discloses to use, as a magnetically biasing magnet, a bond magnet comprising rare-earth magnetic powder with a high magnetic coercive force and binder which are mixed together with each other and compacted into a shape, thereby the DC superposition characteristic and temperature elevation of the core being improved.

Recently, a power supply has been more and more strongly required to improve its power transformation efficiency to such a high level that it is difficult to determine good and bad of magnetic cores for choke coils and transformers by core temperatures measured. Therefore, it is inevitable to determine it from core loss data measured by use of a core-loss measuring device. According to the study by the present inventors, it was confirmed that the core loss has a degraded value in cores having the resistance value disclosed in JP-A 50-133453.

Further, there have recently been demands for coil parts of a surface-mount type. Those coil parts are subjected to reflow soldering process so as to be surface-mounted on a circuit board. It is desired that a magnetic core of the coil part be not degraded in its magnetic properties under conditions of the reflow soldering process. Further, the magnet is desired to have oxidation resistance.

SUMMARY OF THE INVENTION

It is a theme of this invention to provide a magnetic core being excellent in magnetic properties and core-loss characteristics and having a magnetically biasing magnet which is disposed in the vicinity of at least one magnetic gap formed in a magnetic path of the core for magnetically bias the core through opposite ends of the magnetic gap.

It is an object of this invention to provide a magnetic core that is excellent in the magnetic properties and core-less characteristics under conditions of the reflow soldering process.

It is another object of this invention to provide an inductance element or part having a magnetic core having excellent DC superposition characteristics and core-loss characteristics.

According to this invention, there is provided a magnetic core having at least one magnetic gap in a magnetic path thereof. The magnetic core comprises a magnetically biasing magnet disposed in the magnetic gap to provide a magnetic bias from opposite ends of the magnetic gap to the core. The magnetically biasing magnet comprises a bond magnet which comprises rare-earth magnetic powder and a binder resin. The rare-earth magnetic powder has an intrinsic coercive force of 5 kOe or more, a Curie temperature Tc of 300° C. or more, specific resistance of 0.1 Ω·cm or more, residual magnetization Br of 1000 to 4000 G and coercive force bHc of a B-H curve of 0.9 kOe or more.

It is preferable that the intrinsic coercive force is equal to or larger than 10 kOe, the Curie temperature Tc being equal to or larger than 500° C., and the specific resistance being equal to or larger than 1 Ω·cm.

According to another aspect of this invention, there is obtained an inductance part which comprises the magnetic core according to this invention, and at least one winding wound by one or more turns on said magnetic core.

DESCRIPTION OF THE PREFERRED EMBODIMENTS

Now, embodiments of this invention will be described below with reference to the drawings.

Figure 1:
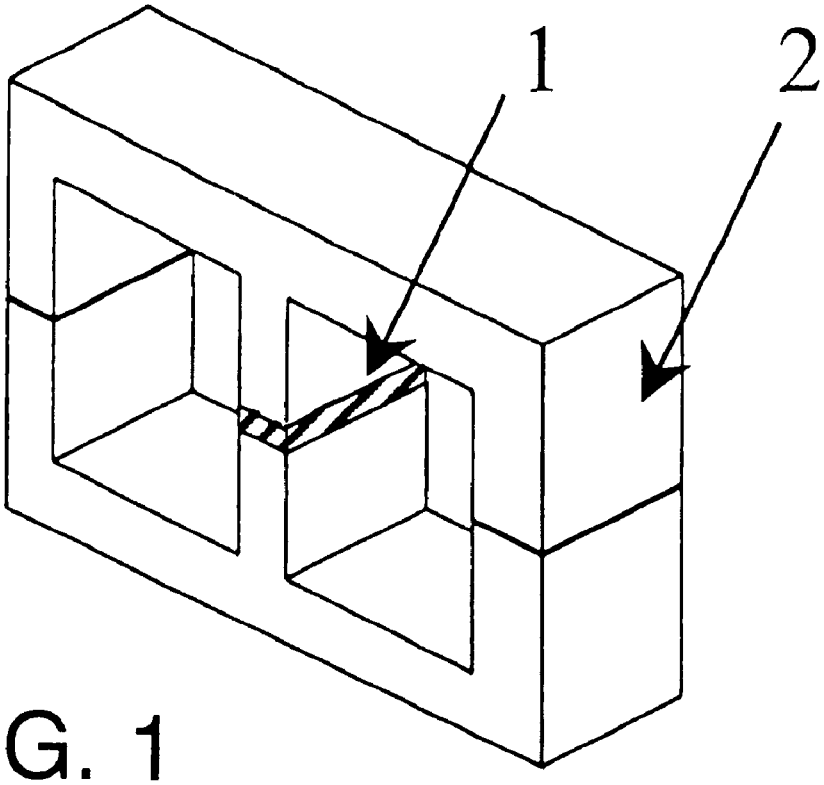
FIG. 1 is a perspective view of a magnetic core according to an embodiment of this invention.

Referring to FIG. 1, a magnetic core according to an embodiment of this invention comprises two E-shape ferrite cores 2 butted to each other. There is a gap left between facing ends of middle legs of two E-shape ferrite cores 2, in which gap a permanent magnet 1 is inserted and disposed for providing a biasing magnetic field.

Figure 2:
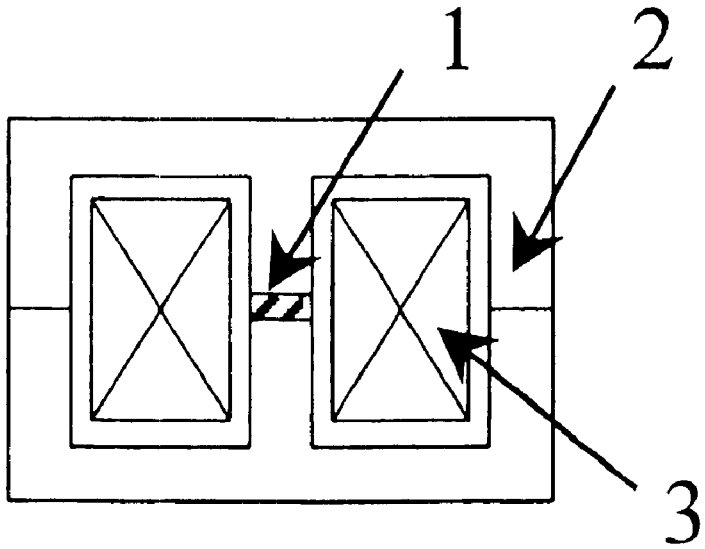
FIG. 2 is a front view of an inductance part comprising a magnetic core of FIG. 1 and a winding wound on the core.

Referring to FIG. 2, there is shown an inductance part composed by applying a wire winding 3 onto the magnetic core shown in FIG. 1.

The present co-inventors studied a possibility of a permanent magnet for providing a biasing magnetic field as shown at 1 in FIGS. 1 and 2. The co-inventors resultantly obtained a knowledge that a use of a permanent magnet having a specific resistance of 0.1 Ω·cm or more (preferably 1 Ω·cm or more) and an intrinsic coercive force iHc of 5 kOe or more can provide a magnetic core which has an excellent DC superposition characteristics and a non-degraded core-loss characteristic. This means that the property of the magnet necessary for obtaining an excellent DC superposition characteristic is the intrinsic coercive force rather than the energy product. Thus, this invention is based on the findings that the use of a permanent magnet having a high specific resistance and a high intrinsic coercive force can provide a sufficient high DC superposition characteristic.

The permanent magnet having a high specific resistance and a high intrinsic coercive force as described above can be realized by a rare-earth bond magnet which is formed of rare-earth magnetic powder having an intrinsic coercive force of 5 kOe or more and a binder mixed together, then compacted. However, the magnetic powder used is not limited to the rare-earth magnetic powder but any kind of magnetic powder which has a high coercive force such as an intrinsic coercive force of 5 kOe or more. The rare-earth magnetic powder includes SmCo series, NdFeB series, SmFeN series, and others. Further, taking thermal magnetic reduction into consideration, the magnetic powder used is required to have a Curie point Tc of 300° C. or more and an intrinsic coercive force of 5 kOe or more.

Considering a temperature in the reflow soldering process, the magnetic powder used is necessary to have a specific resistance of 1 Ω·cm or more, an intrinsic coercive force iHc of 10 kOe or more and a Curie point Tc of 500° C. or more. As an example of the magnetic powder, $Sm_2Co_{17}$ magnet is recommended among various rare-earth magnets.

An intrinsic coercive force of 5 kOe or more is necessary since the intrinsic coercive force of the permanent magnet would be extinguished by a magnetic field generated in a magnetic path of the magnetic core when the intrinsic coercive force of the permanent magnet is smaller than 5 kOe. Although larger specific resistance is preferable for the permanent magnet, a specific resistance of 1 Ω·cm or more will not be a main cause of deterioration of core-loss characteristics.

The average particle size of the magnetic powder is desired 50 $\mu$m or less at the maximum because the use of magnetic powder having the average particle size larger than 50 $\mu$m results in degradation of the core-loss characteristic. While the minimum value of the average particle size is required 2.5 $\mu$m or more because the powder having the average particle size less than 2.5 $\mu$m is significant in magnetization reduction due to oxidation of particles caused by a power heat treatment and a reflow soldering process.

The present co-inventors have found, through various studies, that the effect of the thermal demagnezation is alleviated when the bond magnet has residual magnetization (remnant magnetic flux density) Br of 4000 G or less. The reason may be elucidated as follows. A bond magnet having low permeance is in an irreversible demagnetization region when residual magnetization Br exceeds 4000 G, because the coercive force bHc of the B-H curve lies under a knick point. When residual magnetization Br is smaller than 4000 G, on the other hand, the effect of thermal demagnetization is alleviated since the bond magnet is in a reversible demagnetization region because coercive force bHc lies above the knick point of the B-H curve. Accordingly, the effect of thermal demagnetization is small (even after the reflow treatment) to permit good DC superposition characteristic to be obtained with high reliability, when the bond magnet has residual magnetization Br of 4000 G or less.

A magnetic core for a choke coil or a transformer can be effectively made of any kind of materials which have a soft magnetism. Generally speaking, the materials include ferrite of MnZn series or NiZn series, dust core, silicon steel plate, amorphous or others. Further, the magnetic core is not limited to a special shape but the permanent magnet according to this invention can be used in a magnetic core having a different shape such as toroidal core, E—E core, E-I core or others. Each of these magnetic core has at least one magnetic gap formed in its magnetic path in which gap the permanent magnet is disposed. Although the gap is not restricted in a length thereof, the DC superposition characteristic is degraded when the gap length is excessively small. When the gap length is, on the other hand, excessively large, the permeability is lowered. Accordingly, the gap length is determined automatically.

Now, examples according to this invention will be described below.

EXAMPLE 1

For obtaining a magnet powder with an intrinsic coercive force of 5 kOe or more and Curie temperature Tc of 300° C. or more, an alloy of $Sm_2Fe_{17}$ was coarsely crushed followed by fine grinding in an organic solvent with a ball mill, thereby obtaining an alloy powder with an average particle size of 5 $\mu$m. Then, the powder obtained was nitrified and magnetized to obtain a magnetic power of $Sm_2Fe_{17}N_3$. Next, the magnetic powder obtained was mixed with an epoxy resin as a binder in the proportions of the resin of 1 wt %, 3 wt %, 5 wt %, 10 wt %, 15 wt % and 20 wt % in order to manufacture six kinds of bond magnet with different binder contents, and each of the mixtures was molded in a die without applying any magnetic field. Magnetic properties of the bond magnets thus obtained are shown in Table 1.

TABLE 1

| Binder Content (wt %) | 1.0 | 3.0 | 5.0 | 10 | 15 | 20 |
|---|---|---|---|---|---|---|
| Br(kG) | 2.13 | 2.10 | 1.75 | 1.42 | 1.12 | 0.95 |
| Hc(kOe) | 9.8 | 9.8 | 9.7 | 9.8 | 9.8 | 9.7 |

Subsequently, each of the bond magnets manufactured was processed into a sample with a dimension of 7.0×10.0×1.5 mm, and magnetized in the direction of thickness with a pulse magnetic field of 4T. Magnetic flux of each sample was measured with a digital fluxmeter TD F-5 made by TOEI Co. at a temperature of 25° C. After measuring each sample, it was placed in a constant temperature chamber, heated at a temperature of 50° C., and held at the temperature for 1 hour. The bond magnet was heated in Ar (argon) as an inert gas in order to eliminate the effect of permanent demagnetization caused by oxidation of the bond magnet powder. The heated bond magnet was cooled to room temperature thereafter, and was left alone for additional two hours. Then, the magnetic flux of each sample was measured by the same method as described above. Further, the magnetic flux of each sample was measured in each case where the temperature of the constant temperature chamber is changed from 75° C. to 200° C. at intervals of 25° C. The results are shown in FIG. 3.

Figure 3:
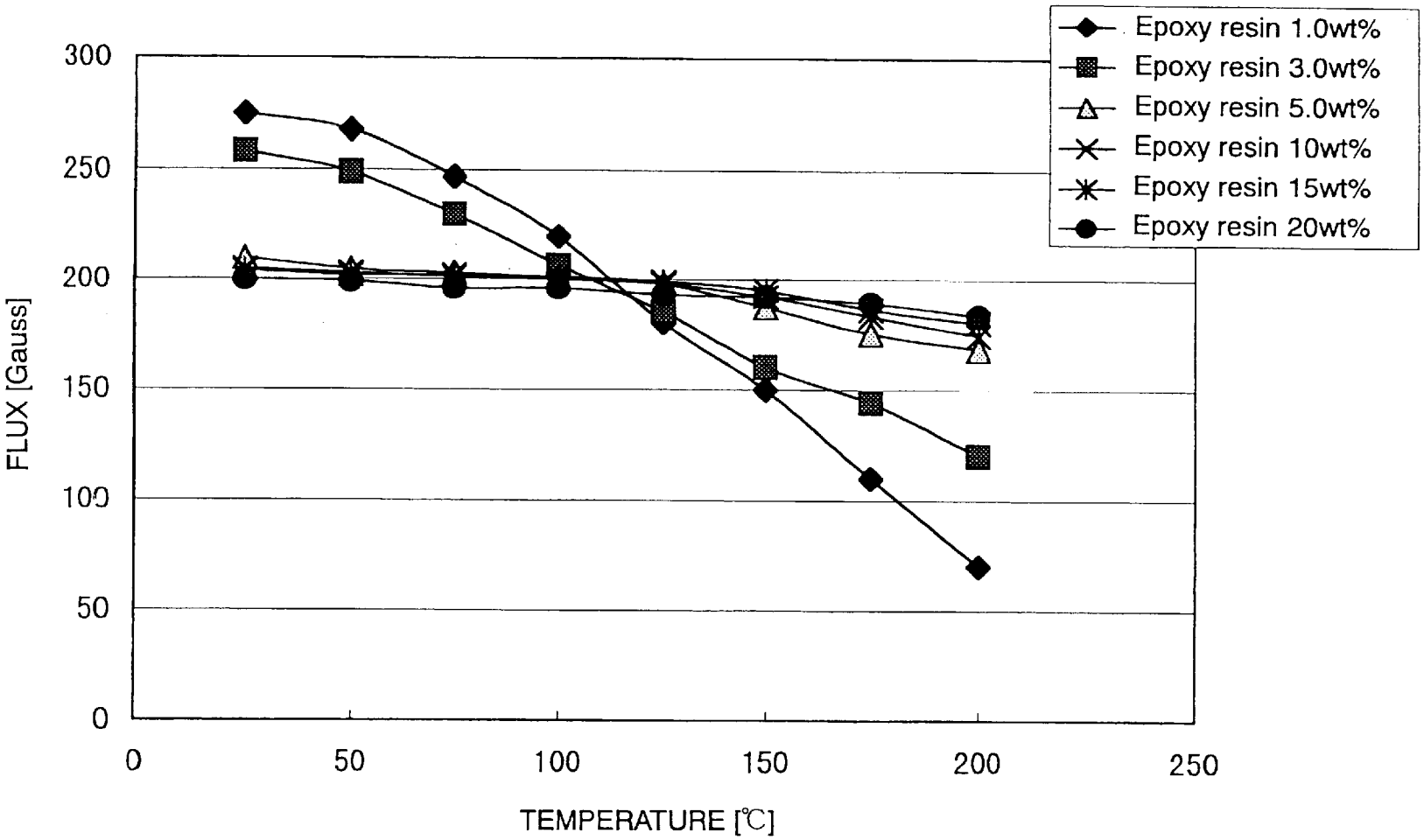
FIG. 3 graphically shows relationships between treating temperature and measured flux of sample permanent magnets in Example 1 which have different epoxy resin contents.

FIG. 3 shows that the thermal demagnetization ratio is small to render the bond magnet reliable regardless of the temperature of the constant temperature chamber between 50° C. and 200° C., when the binder content is 5 wt % or less.

Figures 4A, 4B:
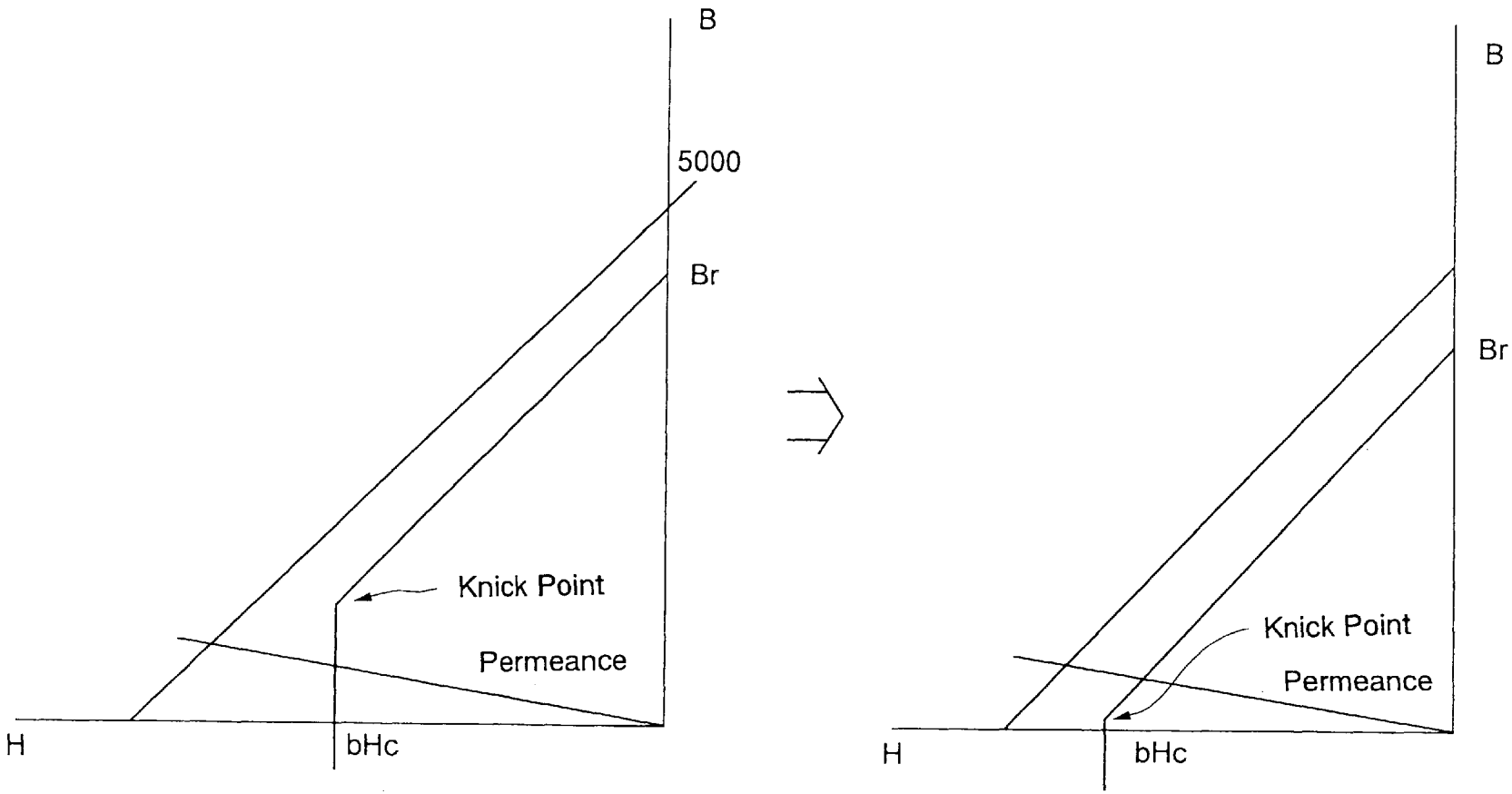
FIG. 4A is a graph showing a B-H curve of a permanent magnet having a relatively high residual magnetization.
FIG. 4B is a graph showing a B-H curve of a permanent magnet having a relatively low residual magnetization.

The thermal demagnetization ratio is small because, while coercive force bHc of the B-H curve lies under a knick point as shown in FIG. 4A when the binder content is less than 5 wt %, magnet is in a reversible demagnetization region since the coercive force bHc lies above the knick point of the B-H curve as shown in FIG. 4B when the binder content is 5 wt % or more. This is because the increased binder content results in low residual magnetization Br in the bond magnet having low permeance. Consequently, the effect of thermal demagnetization is more alleviated in the bond magnet having lower residual magnetization Br. These results indicate that the bond magnet desirably has residual magnetization Br of 4000 G or less.

Figure 5:
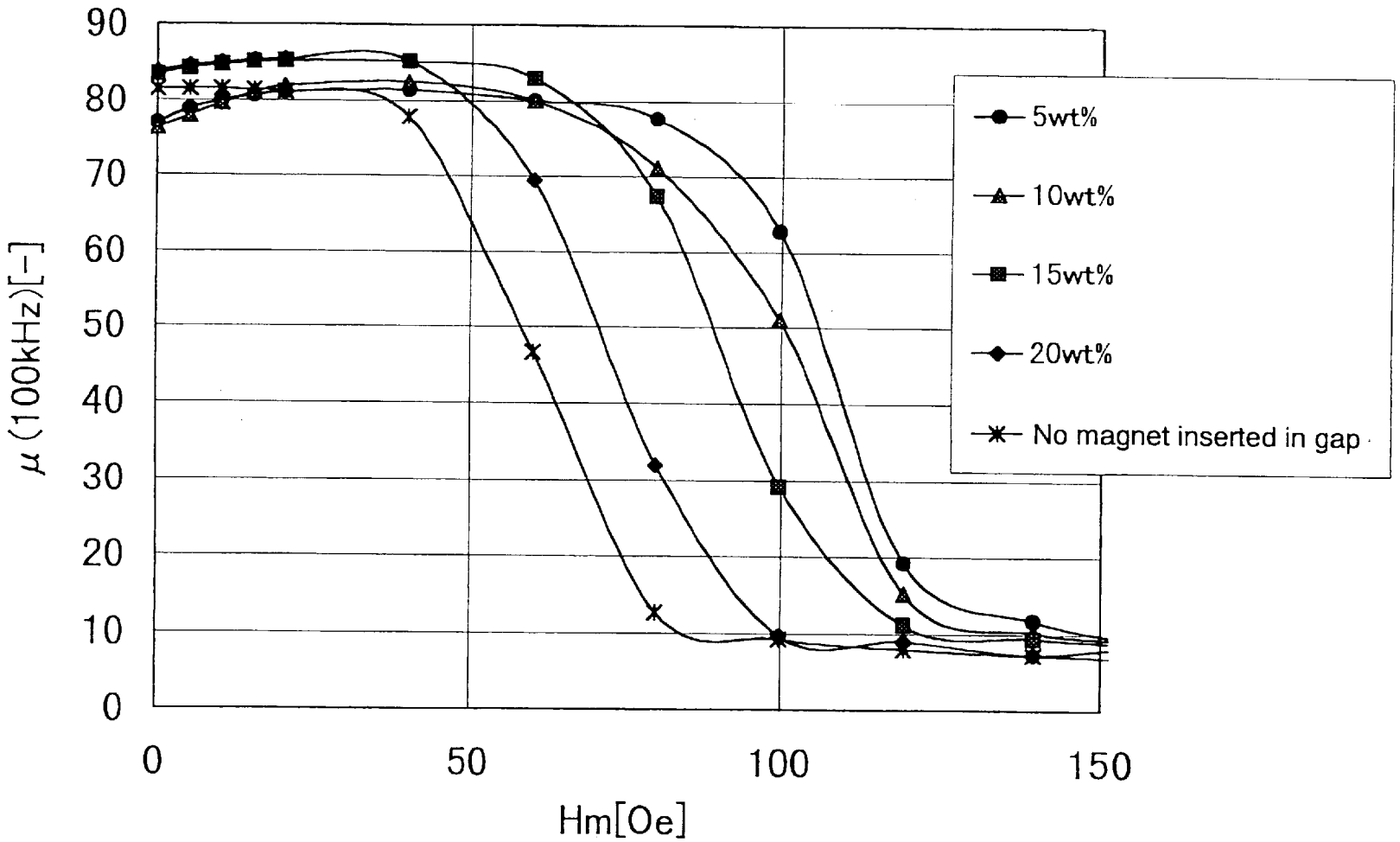
FIG. 5 graphically shows measured DC superposition characteristics (permeability) $\mu$ of a magnetic core using each of the sample magnets in Example 1.

In the next step, in order to the obtain samples as the inductance part illustrated in FIG. 2, a gap with a length of 1.5 mm was made at the middle leg of an EE core (a ferrite core) 2, which was manufactured using a conventional MnZn series ferrite material, and has a magnetic path length of 7.5 cm and an effective sectional area of 0.74 $cm^2$. A bond magnet 1 to be inserted into the gap of the EE core 2 was manufactured using each of the four kinds of the bond magnets, which showed small thermal demagnetization ratio, containing 5 wt % or more of the binder. In other words, each of the bond magnets containing 5 wt %, 10 wt %, 15 wt % and 20 wt % was machined into a thickness of 1.5 mm with the same shape as the cross-sectional shape of the middle leg of the EE core 2, and the piece of the bond magnet was magnetized in the direction of thickness by applying a magnetic field of 4 T using a pulse magnetizer. Each of the bond magnet 1 thus manufactured was inserted into the gap of the EE core 2, and one turn or more of a wire winding 3 was provided at a winding part to complete an inductance part. The DC superposition characteristics of the completed inductance component were repeatedly measured using an LCR meter five times, and magnetic permeability $\mu$ was calculated from the core constant and the number of turns of the wire winding 3. The results are shown in FIG. 5. In FIG. 5, a horizontal axis represents superposed magnetic field Hm. Additionally, FIG. 5 also shows a result of measurements of a comparative sample having no inserted magnet in the gap of the EE core.

FIG. 5 shows that the characteristics approach the characteristics of the comparative sample with no inserted magnet in the gap as the content of the binder in the bond magnet increases. This is because increased content of the binder results in decrease of residual magnetization Br. When the binder content is 20 wt %, there are no large improvements in the characteristics as compared with the bond magnet having no inserted magnet. It is evident from this result and the results in Table 1 that residual magnetization Br of at least 1000 G is essential.

It is evident from the results above and consideration to the heat demagnetization characteristics and the DC superposition characteristics that residual magnetization Br of 1000 to 4000 G is desirable for the bond magnet as the magnetically biasing magnet.

According to other experiments, the DC superposition characteristics were good after heat treatment when the coercive force bHc is 0.9 kOe or more.

In order to confirm that the bond magnet is not affected by permanent demagnetization caused by oxidation of the powder, the magnet is pulse-magnetized again after heat treatment. Subsequently, characteristics of the bond magnet were measured. As a result, the bond magnet exhibited almost the same characteristics as those before the heat treatment, enabling no effect of permanent demagnetization due to oxidation of the powder to be confirmed. It was also confirmed from the other experiments that no permanent demagnetization by oxidation of the powder was observed when the average particle size is 2.5 $\mu$m or more, while no deterioration of the core-loss characteristics was observed when the average particle size is 50 $\mu$m or less.

A magnetic core and an inductance component having excellent DC superposition characteristics may be obtained with little thermal demagnetization by inserting a bond magnet into a gap formed at the middle leg of the EE core, wherein the bond magnet comprises a powder of a rare earth magnet with a particle size of 2.5 to 50 $\mu$m having an intrinsic coercive force of 5 kOe or more and Curie temperature Tc of 300° C. or more, and has residual magnetization Br of 1000 to 4000 G, coercive force bHc of 0.9 kOe or more and specific resistance of 1 Ω·cm or more.

EXAMPLE 2

For obtaining a magnet powder with an intrinsic coercive force of 10 kOe or more and Curie temperature Tc of 500° C. or more, a $Sm_2Co_{17}$ series sintered magnet with an energy product of about 28 MGOe was coarsely crushed followed by fine grinding in an organic solvent with a ball mill, thereby obtaining an magnetic powder with an average particle size of 10 $\mu$m. Then, the magnetic powder obtained was mixed with an epoxy resin as a binder in the proportions of the resin of 1 wt %, 3 wt %, 5 wt %, 10 wt %, 15 wt % and 20 wt % in order to manufacture six kinds of bond magnet with different binder contents, and each of the mixtures was molded in a die without applying any magnetic field. Magnetic properties of the bond magnets thus obtained are shown in Table 2.

TABLE 2

| Binder Content (wt %) | 1.0 | 3.0 | 5.0 | 10 | 15 | 20 |
|---|---|---|---|---|---|---|
| Br(kG) | 4.30 | 4.01 | 3.61 | 2.83 | 2.01 | 1.24 |
| Hc(kOe) | 15.6 | 15.4 | 15.4 | 15.5 | 15.5 | 15.5 |

Subsequently, each of the bond magnets manufactured was processed into a sample with a dimension of 7.0×10.0×1.5 mm, and magnetized in the direction of thickness with a pulse magnetic field of 4 T. Magnetic flux of each sample was measured like Example 1 with a digital fluxmeter TDF-5 made by TOEI Co. at room temperature (25° C.). After measuring each sample, it was placed in a constant temperature chamber, heated at a temperature of 270° C. which equal to the temperature in the reflow soldering process, and held at the temperature for 1 hour. The bond magnet was heated in Ar (argon) as an inert gas in order to eliminate the effect of permanent demagnetization caused by oxidation of the bond magnet powder. The heated bond magnet was cooled to the room temperature thereafter, and was left alone for additional two hours. Then, the magnetic flux of each sample was measured by the same method as described above. In addition, a decrease rate of the magnetic flux (or the thermal demagnetization ratio) is calculated from the measured magnetic flux of before and after the reflow treatment. The results are shown in Table 3.

TABLE 3

| Binder Content (wt %) | 1.0 | 3.0 | 5.0 | 10 | 15 | 20 |
|---|---|---|---|---|---|---|
| Flux Demegnetization Rate (%) | 4.30 | 4.01 | 3.61 | 2.83 | 2.01 | 1.24 |

Table 3 shows that the thermal demagnetization ratio is small to render the bond magnet reliable even after the reflow treatment, when the binder content is 5 wt % or less. The reason is as mentioned above regarding Example 1 with referring to FIGS. 4A and 4B. Accordingly, the effect of thermal demagnetization is more alleviated in the bond magnet having lower residual magnetization Br. These results also indicate that the bond magnet desirably has residual magnetization Br of 4000 G or less.

Figure 6:
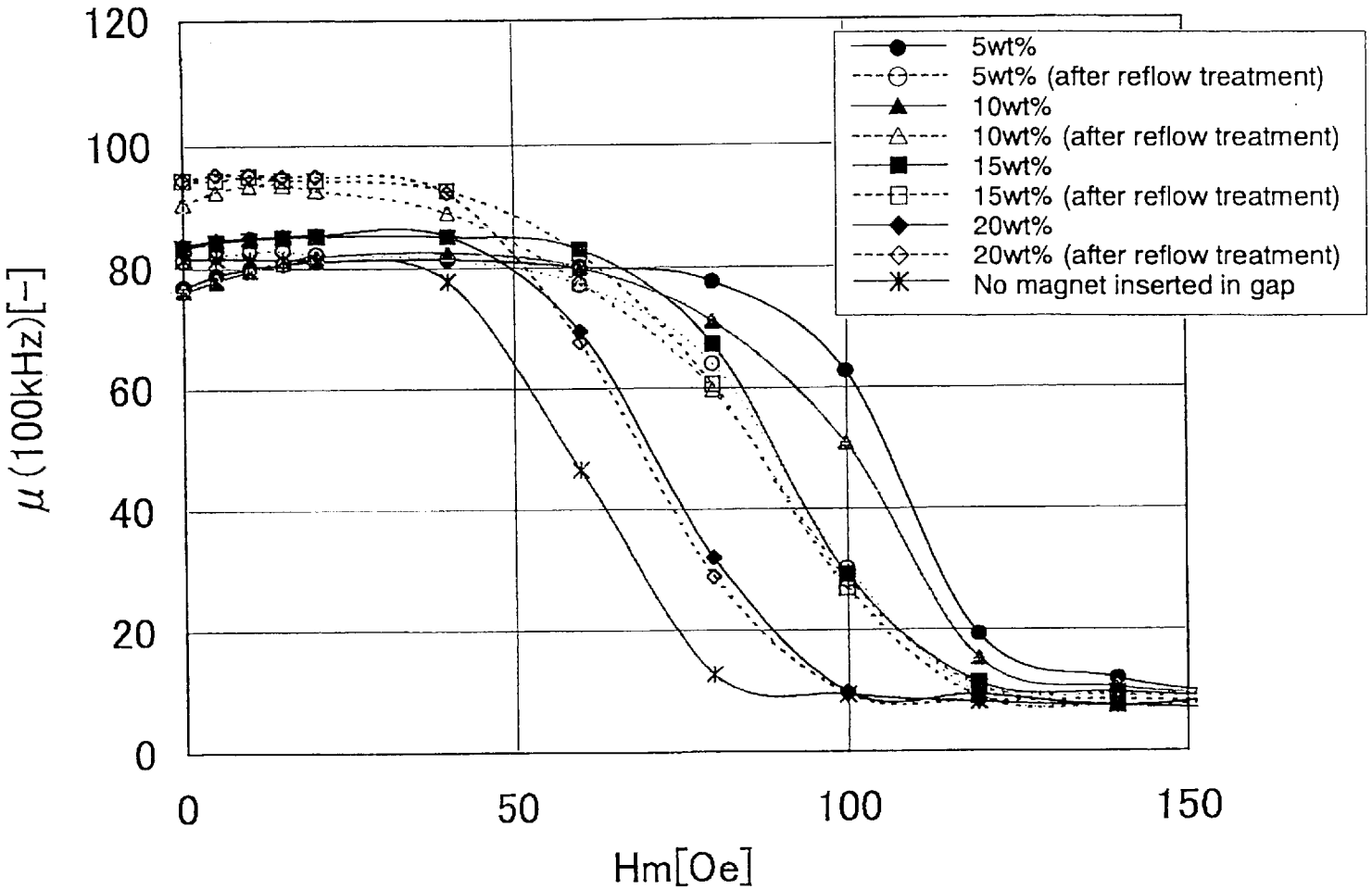
FIG. 6 graphically shows measured DC superposition characteristics (permeability) $\mu$ before and after a reflow treatment of a magnetic core using each of the sample magnets in Example 2 which have different epoxy resin contents.

Next, like Example 1, in order to the obtain samples as the inductance part illustrated in FIG. 2, a gap with a length of 1.5 mm was made at the middle leg of an EE core (a ferrite core) 2, which was manufactured using a conventional MnZn series ferrite material, and has a magnetic path length of 7.5 cm and an effective sectional area of 0.74 $cm^2$. A bond magnet 1 to be inserted into the gap of the EE core 2 was manufactured using each of the four kinds of the bond magnets, which showed small thermal demagnetization ratio, containing 5 wt % or more of the binder. In other words, each of the bond magnets containing 5 wt %, 10 wt %, 15 wt % and 20 wt % was machined into a thickness of 1.5 mm with the same shape as the cross-sectional shape of the middle leg of the EE core 2, and the piece of the bond magnet was magnetized in the direction of thickness by applying a magnetic field of 4 T using a pulse magnetizer. Each of the bond magnet 1 thus manufactured was inserted into the gap of the EE core 2, and one turn or more of a wire winding 3 was provided at a winding part to complete an inductance part. The DC superposition characteristics of the completed inductance component were measured using an LCR meter, and magnetic permeability $\mu$ was calculated from the core constant and the number of turns of the wire winding 3. The results are shown in FIG. 6. In FIG. 6, a horizontal axis represents superposed magnetic field Hm.

After completing the measurement of the DC superposition characteristics, the sample was heated at 270° C., kept at the temperature for one hour, and cooled to room temperature with additional two hours. Then, the DC superposition characteristics were measured again using the LCR meter. The results are also listed in FIG. 6. The result of measurements of the sample having no inserted magnet in the gap of the EE core are also shown in FIG. 6 as comparative samples.

FIG. 6 shows that the characteristics have shapes as like as that of FIG. 4 and approach the characteristics of the comparative sample with no inserted magnet in the gap as the content of the binder in the bond magnet increases. When the binder content is 20 wt %, there are no large improvements in the characteristics as compared with the bond magnet having no inserted magnet. As mentioned above, this is because increased content of the binder results in decrease of residual magnetization Br. It is evident from this result and the results in Table 2 that residual magnetization Br of at least 1000 G is essential.

It is evident from the results above and consideration to the heat demagnetization characteristics and the DC superposition characteristics that residual magnetization Br of 1000 to 4000 G is desirable for the bond magnet as the magnetically biasing magnet.

According to other experiments, the DC superposition characteristics were good after reflow treatment when the coercive force bHc is 0.9 kOe or more.

In order to confirm that the bond magnet is not affected by permanent demagnetization caused by oxidation of the powder, the magnet is pulse-magnetized again after reflow treatment. Subsequently, characteristics of the bond magnet were measured. As a result, the bond magnet exhibited almost the same characteristics as those before the heat treatment, enabling no effect of permanent demagnetization due to oxidation of the powder to be confirmed. It was also confirmed from the other experiments that no permanent demagnetization by oxidation of the powder was observed when the average particle size is 2.5 $\mu$m or more, while no deterioration of the core-loss characteristics was observed when the average particle size is 50 $\mu$m or less.

A magnetic core and an inductance component having excellent DC superposition characteristics may be obtained with little thermal demagnetization by inserting a bond magnet into a gap formed at the middle leg of the EE core, wherein the bond magnet comprises a powder of a rare earth magnet with a particle size of 2.5 to 50 $\mu$m having an intrinsic coercive force of 10 kOe or more and Curie temperature Tc of 500° C. or more, and has residual magnetization Br of 1000 to 4000 G, coercive force bHc of 0.9 kOe or more and specific resistance of 1 Ω·cm or more.

EXAMPLE 3

Each magnetic powder and resin were kneaded in the compositions shown in Table 4, and samples (i.e. thin plate magnets) with a thickness of 0.5 mm were manufactured by molding and machining.

TABLE 4

| Samples | Magnetic Powder Resin | iHc (kOe) | Mixing Parts (wt. parts) |
|---|---|---|---|
| S-1 | $Sm(Co_{0.742}Fe_{0.20}Cu_{0.055}Zr_{0.029})_{7.7}$ | 15 | 100 |
| | Aromatic Polyamide Resin | — | 100 |
| S-2 | $Sm(Co_{0.742}Fe_{0.20}Cu_{0.055}Zr_{0.029})_{7.7}$ | 15 | 100 |
| | Soluble Polyimide Resin | — | 100 |
| S-3 | $Sm(Co_{0.742}Fe_{0.20}Cu_{0.055}Zr_{0.029})_{7.7}$ | 15 | 100 |
| | Epoxy Resin | — | 100 |
| S-4 | $Sm_2Fe_{17}N$ magnetic powder | 10 | 100 |
| | Aromatic Polyamide Resin | — | 100 |
| S-5 | Ba ferrite magnetic powder | 4.0 | 100 |
| | Aromatic Polyamide Resin | — | 100 |
| S-6 | $Sm(Co_{0.742}Fe_{0.20}Cu_{0.055}Zr_{0.029})_{7.7}$ | 15 | 100 |
| | Polypropylene Resin | — | 100 |

The $Sm_2Co_{17}$ series and ferrite powders were prepared by grinding corresponding sintered materials, and a $Sm_2Fe_{17}N$ powder was manufactured by nitriding the $Sm_2Fe_{17}$ powder by reductive diffusion. Each powder had an average particle size of about 5 μm. After heat-kneading the aromatic polyamide resin (6T nylon) or polypropylene resin in Ar at 300° C. (polyamide) or 250° C. (polypropylene) with one of the magnetic powders, the mixture was molded with a hot-press to prepare each sample. In the case of the soluble polyimide resin, γ-butyrolactone as a solvent was added and the solution was stirred with a centrifugal defoamer for 5 minutes to prepare a paste. A green sheet with a final thickness of 500 μm was manufactured from the paste by a doctor blade method, and a sample was manufactured by hot-press after drying. In the case of the epoxy resin, a sample was prepared by molding in a die under an appropriate curing condition after stirring and mixing the resin in a beaker. All these samples had specific resistance of 0.1 Ω·cm or more.

Each of the thin plate magnets was cut into a piece having a cross-section of the middle leg of the ferrite core illustrated in FIG. 1 like Example 1 or Example 2. The core is an EE core with a magnetic circuit length of 5.9 cm and effective cross-sectional area of 0.74 $cm^2$ manufactured using a conventional MnZn series ferrite material. A gap of 0.5 mm was machined in the middle leg of the EE core. The thin plate magnet manufactured as described above was inserted into the gap as shown in FIG. 1 to obtain an inductance part as shown in FIG. 2.

After magnetizing the magnet in the direction of the magnetic circuit with a pulse magnetizer, the DC superposition characteristics was measured at an alternating magnetic field frequency of 100 KHz, and effective magnetic permeability was measured at a DC superposition magnetic field of 35 Oe using an LCR meter (HP-4284A manufactured by Hewlett Packard Co. Naturally, the superposition current is applied to the wire winding 3 so that the direction of the DC superposition magnetic field is reversed to the direction of magnetization of the magnet.

After holding the cores in a reflow furnace heated at 270° C. for 30 minutes, the DC superposition characteristics were measured again under the same conditions as described above.

The magnetic core having no inserted magnet in the gap was also measured as a comparative sample. The characteristics showed no changes before and after the reflow treatment with an effective magnetic permeability μe of 70.

Figure 7:
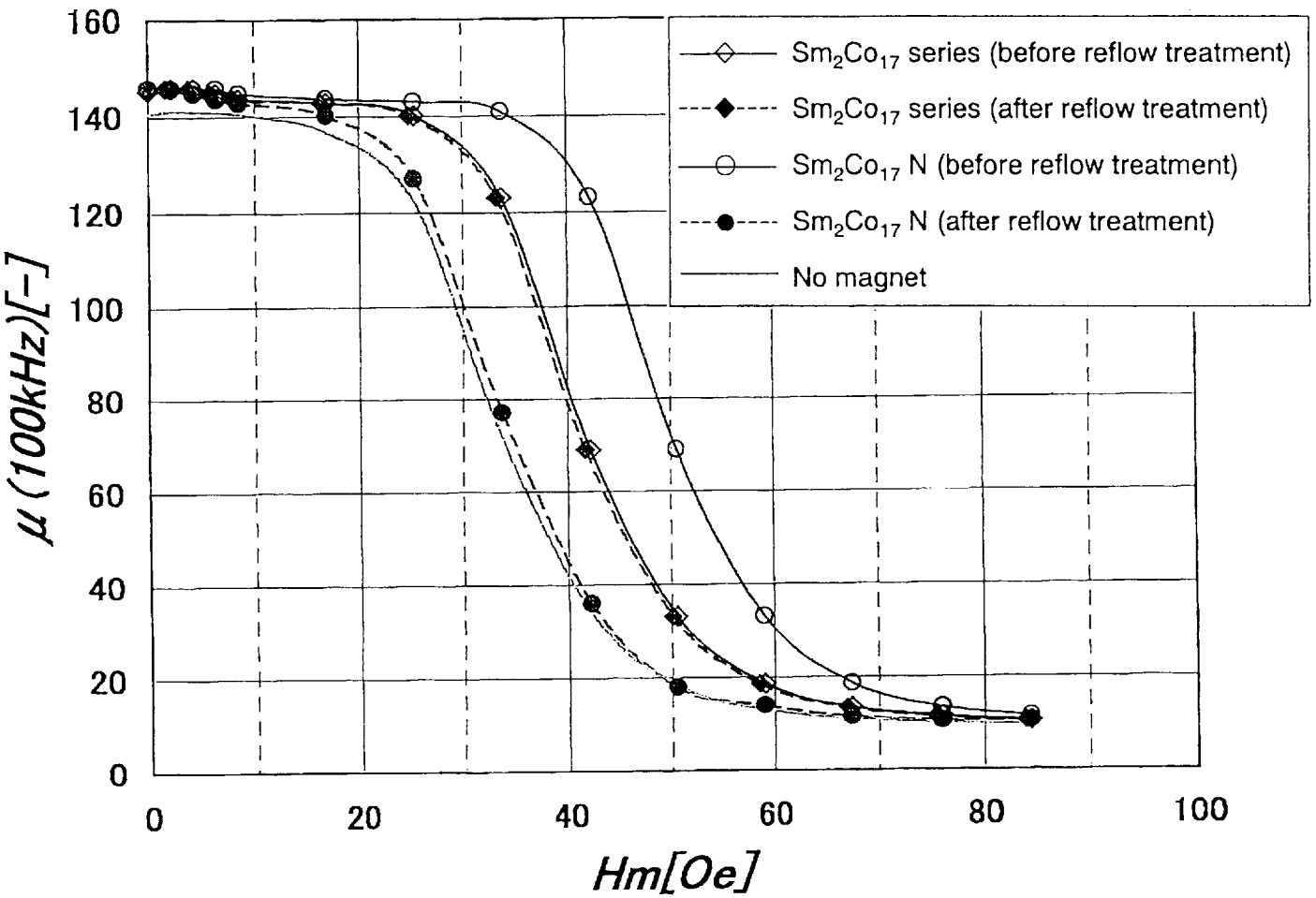
FIG. 7 graphically shows measured DC superposition characteristics (permeability) $\mu$ before and after a reflow treatment of a magnetic core using each of the sample magnets in Example 3 which have different resins.

The results of the effective magnetic permeability μe measured are shown in Table 5. The DC superposition characteristics of the samples S-2 and S-4 and the comparative sample are representatively shown in FIG. 7. Additionally, measurements of the core having an inserted thin plate magnet containing the polypropylene resin were impossible, since the magnet was markedly deformed.

TABLE 5

| Samples | Before Reflow treating μe (at 35 Oe) | After Reflow treating μe (at 35 Oe) |
|---|---|---|
| S-1 | 140 | 130 |
| S-2 | 120 | 120 |
| S-3 | 140 | 120 |
| S-4 | 140 | 70 |
| S-5 | 90 | 70 |
| S-6 | 140 | — |

According to these results, the Ba ferrite bond magnet (sample S-5) is as small as 4 kOe in the coercive force. Therefore, it is considered that the bond magnet is demagnetized or magnetized in the reverse direction by an opposite magnetic field applied thereto, to thereby cause the degradation of the DC superposition characteristics. The magnetic core comprising the inserted $Sm_2Fe_{17}N$ thin plate magnet also shows large degradation of the DC superposition characteristics after the reflow treatment. The magnetic core comprising the inserted $Sm_2Co_{17}$ thin plate magnet with a coercive force of as high as 10 kOe or more practically shows, on the contrary, no degradation of the characteristics, showing very stable characteristics.

It may be conjectured from these results that the magnet was demagnetized or magnetization thereof was reversed by the inverse magnetic field applied to the thin plate magnet due to the small coercive force of the Ba ferrite thin plate magnet, thereby degrading the DC superposition characteristics. It may be conjectured that thermal demagnetization was caused due to low Tc of the SmFeN magnet of 470° C., although the coercive force is high, and the characteristics were degraded by a synergetic effect of demagnetization due to the inverse magnetic field with thermal demagnetization. Accordingly, it was made clear that the a coercive force of 10 kOe or more and Tc of 500° C. or more are necessary for obtaining excellent DC superposition characteristics in the thin plate magnet to be inserted into the core.

The thin plate magnets manufactured by the combinations other than those described in this example, i.e. the thin plate magnets using the resins selected from the polyphenylene sulfite, silicone, polyester and liquid polymer resins, were also confirmed to be able to obtain the same effects as in this example, although they were not embodied in this example.

EXAMPLE 4

After kneading the same $Sm_2Co_{17}$ series magnetic powder as used in Example 3 (iHc=15 kOe) and soluble polyimide resin (Toyobo Biromax) with a compression kneader, the mixture was diluted and kneaded with a planetary mixer followed by stirring for 5 minutes in a centrifugal defoamer to prepare a paste. A green sheet was manufactured from the paste by a doctor blade method so that the sheet have a thickness of about 500 μm after drying. After drying, a thin magnet sample was prepared by hot press followed by machining at a thickness of 0.5 mm. The content of the polyimide-imide resin was adjusted to have specific resistance of 0.06, 0.1, 0.2, 0.5 or 1.0 Ω·cm as shown in Table 6. Each of these thin plate magnet was cut into pieces having the cross-sectional shape of the middle leg of the same core as in Example 3 to prepare samples.

TABLE 6

| Sample | Magnetic Powder | Resin Content (vol %) | Specific Resistance (Ω · cm) | Core Loss ($kW/m^3$) |
|---|---|---|---|---|
| S-1 | Sm | 25 | 0.06 | 1250 |
| S-2 | $(Co_{0.742}Fe_{0.20}Cu_{0.055}Zr_{0.029})_{7.7}$ | 30 | 0.1 | 680 |
| S-3 | | 35 | 0.2 | 600 |
| S-4 | | 40 | 0.5 | 530 |
| S-5 | | 50 | 1.0 | 540 |

The thin plate magnet manufactured as described above was inserted into an EE core having a gap length of 0.5 mm as in Example 3, and the magnet was magnetized with a pulse magnetizer. The core-loss characteristics at 300 kHz and 0.1 T of theses were measured at room temperature using the SY-8232 alternating current BH tracer made by Iwatsu Electric Co. The same ferrite core was used in these measurements, and magnets were replaced with those having different specific resistance to measure the core-loss characteristics again after inserting and magnetizing each of the magnet with the pulse magnetizer.

The results are also shown in Table 6. As a comparative sample, the same EE core having the cap with no magnet therein has a core-loss of 520 $kW/m^2$ which was measured at the same measuring condition. According to Table 6, the magnetic core has an excellent core-loss property in use of the magnet having the specific resistance of 0.1 Ω·cm or more. This is considered that use of a thin magnet having the high specific resistance can suppress to the eddy current.

What is claimed is:

1. A magnetic core having at least one magnetic gap in a magnetic path thereof, said magnetic core comprising a magnetically biasing magnet disposed in the magnetic gap for providing a magnetic bias from opposite ends of the magnetic gap to the core, wherein said magnetically biasing magnet comprises a bond magnet which comprises rare-earth magnetic powder and a binder resin, said rare-earth magnetic powder having an intrinsic coercive force of 5 kOe or more, a Curie temperature Tc of 300° C. or more, specific resistance of 0.1 Ω·cm or more, residual magnetization Br of 1000 to 4000 G and coercive force bHc of a B-H curve of 0.9 kOe or more.

2. A magnetic core as claimed in claim 1, wherein said intrinsic coercive force is equal to or larger than 10 kOe, said Curie temperature Tc being equal to or larger than 500° C., and said specific resistance being equal to or larger than 1 Ω·cm.

3. An inductance part which comprises the magnetic core claimed in claim 1, at least one winding wound by one or more turns on said magnetic core.

4. An inductance part which comprises the magnetic core claimed in claim 2, at least one winding wound by one or more turns on said magnetic core.

* * * * *